United States Patent [19]

McAliley et al.

[11] Patent Number: 4,633,550

[45] Date of Patent: Jan. 6, 1987

[54] YARN ENTANGLING APPARATUS

[75] Inventors: John E. McAliley; James R. Crozier, Jr., both of Rock Hill, S.C.

[73] Assignee: BASF Aktiengesellschaft, Fed. Rep. of Germany

[21] Appl. No.: 717,405

[22] Filed: Mar. 29, 1985

[51] Int. Cl.[4] ..... D02G 1/16; D02J 1/08

[52] U.S. Cl. ..... 28/272; 28/276

[58] Field of Search ..... 28/272, 274, 275, 276, 28/271; 57/350, 333

[56] References Cited

U.S. PATENT DOCUMENTS

| | | | |
|---|---|---|---|
| 3,093,879 | 6/1963 | Yamamoto | 28/271 |
| 3,324,526 | 6/1967 | Burns et al. | 28/272 X |
| 3,339,362 | 9/1967 | Dodson, Jr. et al. | 57/350 X |
| 3,367,100 | 2/1968 | Hughey | 28/276 X |
| 3,698,612 | 10/1972 | Brock | 28/272 X |
| 3,822,449 | 7/1974 | Dick | 28/272 |

FOREIGN PATENT DOCUMENTS

| | | | |
|---|---|---|---|
| 956091 | 10/1974 | Canada | 28/276 |

*Primary Examiner*—Robert R. Mackey

*Attorney, Agent, or Firm*—Burns, Doane, Swecker & Mathis

[57] ABSTRACT

An apparatus for entangling filamentary yarns comprises first and second blocks which are positionable in mutually superimposed relationship. Each block includes a plurality of channels and a plurality of fluid ports. The channels are located so that when the blocks are in superimposed relationship, respective ones of the channels are aligned to define yarn passages through which yarns can be fed. The fluid ports communicate with the yarn passages and are communicable with pressurized fluid to create a turbulent fluid flow within respective ones of the yarn passages for entangling the yarns. A motor actuated mechanism separates the first and second blocks to provide simultaneous and immediate access to the interior of the yarn passages. When the blocks are separated, the yarn can be continually fed therethrough to pull trash through the yarn passages. Each block includes a base section and a head section removably attached thereto.

22 Claims, 8 Drawing Figures

FIG. 3
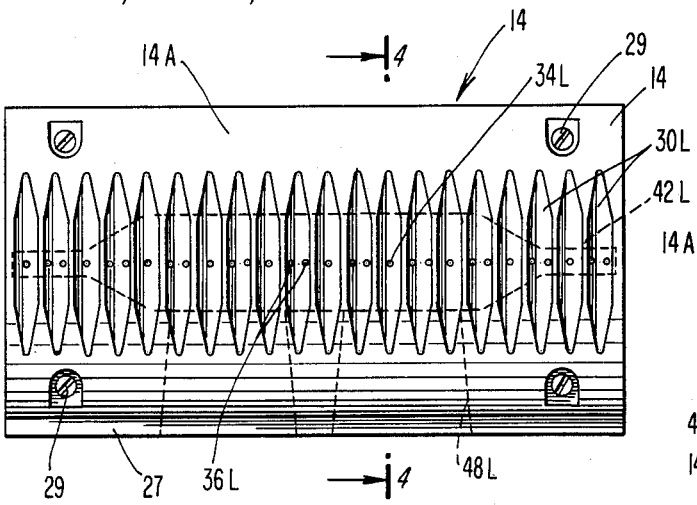
FIG. 4
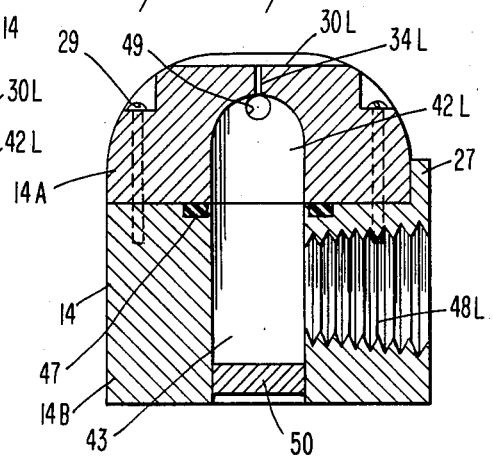
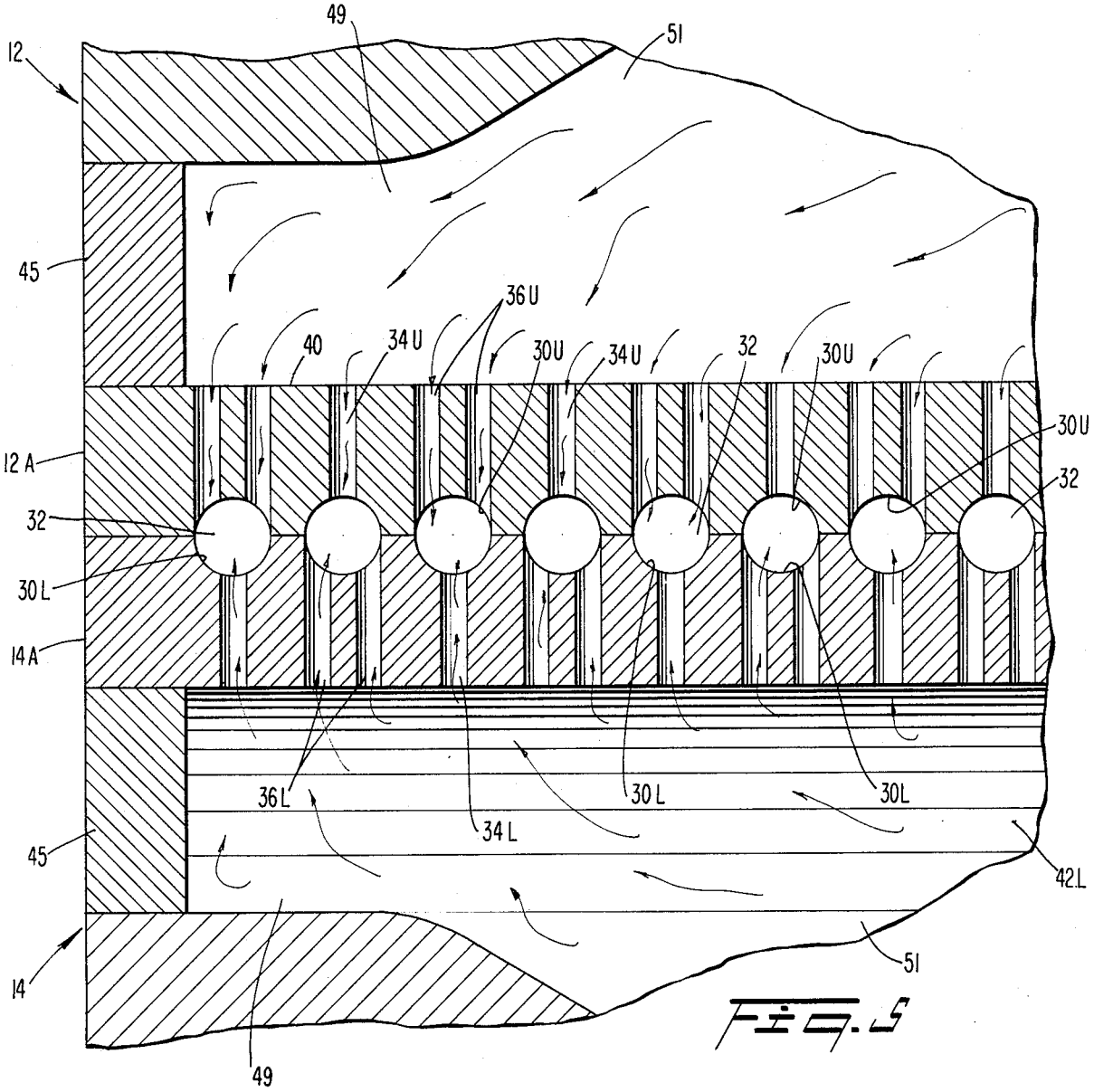
FIG. 5

YARN ENTANGLING APPARATUS

RELATED INVENTION

Attention is directed to copending U.S. application Ser. No. 527,728 now U.S. Pat. No. 4,534,919 issued Aug. 13,1985 and 647,739 abandoned in favor of continuation-in-part application Ser. No. 748,781 filed June 27, 1985 which relate to a process and product involving the disruption of filaments from a parallel relationship.

BACKGROUND AND OBJECTS OF THE INVENTION

The present invention relates to an apparatus for entangling fiber yarns, especially carbon fiber yarns.

The entangling or twisting of bundles of yarn has been long practiced in the art as a means of compacting and unifying a yarn bundle which resists the pulling out of individual filaments during winding, knitting, weaving, etc. Twisting has also been employed as a means of decolumnizing a carbon fiber bundle which renders the bundle more adaptable to being impregnated by a matrix-forming resin as noted in the above-referenced applications, the disclosures of which are hereby incorporated by reference herein.

One previously employed entangling apparatus, disclosed in U.S. Pat. No. 3,727,274, comprises a block in which there is formed a cylindrical bore for conducting the travel of a bundle of filamentary material therethrough. A narrow string-up slot communicates with the bore and extends to one side of the block to enable the filamentary material to be inserted into the bore. Also communicating with the bore are three fluid ports, two of which are mutually parallel and oriented tangentially relative to the bore, and the other of which is oriented radially relative to the bore. As a bundle of filamentary material passes through the bore, pressurized air or water is introduced simultaneously through the three fluid ports. The water impinges against the bundle in such manner that the bundle is opened and simultaneously interleaved to an entangled condition. For ease of fabrication, the block is formed as two segments which are clamped or screwed together, the parting line between the segments being disposed in a common plane with the longitudinal axis of the bore. A plurality of the above-described jets, mounted on a common base, handle a plurality of yarns which are being simultaneously fed.

Although such an entangling apparatus has performed successfully, room for improvement remains. For example, a common occurrence in the use of such jets is the accumulation of "trash" such as broken fibers, at the inlet end of the yarn passage. When the trash reaches the inlet end of the respective yarn passage, it is prevented from entering the passage due to the water flow emanating from such inlet end. Consequently, the trash builds up and eventually obstructs the yarn travel to such an extent that the yarn may break. This problem is of particular concern in the case of carbon yarns, which are relatively fragile. Thus, it would be desirable to be able to clear the trash without endangering the yarn or halting production. In this regard, the string-up slots employed in the previously described jets tend to become clogged with trash and must be cleaned out in what amounts to a time-consuming operation.

Furthermore, it is customary to feed hundreds of yarns simultaneously in the same plane. Thus, it is necessary to provide a like number of jets. Understandably, then, the area occupied by the jets can become quite significant and create serious space problems. It would be desirable, therefore, to reduce, to as great an extent as possible, the space occupied by the jets.

A further consideration relates to the fact that the ports disposed within the jets for conducting water to the yarn passages are quite small and thus must be occasionally cleaned. If not easily accessible, a cleaning operation can be rather difficult and time consuming. Therefore, it would be desirable to enable the inlet and outlet ends of those ports to be easily accessible for cleaning.

It is, therefore, an object of the present invention to provide a novel apparatus for entangling filamentary yarn, especially carbon filamentary yarn.

Another object is to provide such an apparatus in which built-up trash is easily and inexpensively cleared.

A further object is to minimize the fuzz level of the resulting yarns.

An additional object is to minimize the spacing between jets to accomodate as many yarns as possible within a given size space.

One further object is to enable the inlets and outlets of the fluid ports to be easily cleaned.

An additional object is to provide such an apparatus which involves a smaller capital investment and is of less cost to operate and maintain.

SUMMARY OF THE INVENTION

These and other objects are achieved by the present invention which involves methods and apparatus for entangling filamentary yarns. The apparatus comprises first and second blocks positionable in mutually superimposed relationship. Each block includes a plurality of channels and a plurality of fluid ports. The channels are located so that when the blocks are in superimposed relationship, respective ones of the channels are aligned to define yarn passages through which yarns can be fed. The fluid ports communicate with the yarn passages and are communicable with pressurized fluid to create a turbulent fluid flow within respective ones of the yarns passages for entangling the yarns. A motor actuated mechanism is provided for separating the first and second blocks to provide simultaneous and immediate access to the interior of the yarn passages.

Each block preferably comprises a base section and a head section removably affixed together. The head section carries the channels and the fluid ports, the base section carrying fluid conduits which communicate with the fluid ports.

In a method aspect of the present invention, the motor acutated mechanism is operated to separate the blocks while shutting the fluid flow to the fluid ports and feeding yarns through the channels of one of the blocks to cause the yarns to pull trash through the channels.

THE DRAWINGS

The objects and advantages of the invention will become apparent from the following detailed description of a preferred embodiment thereof, in connection with the accompanying drawings, in which like numerals designate like elements and in which:

FIG. 3 is a top plan view of the lowermost one of the blocks depicted in FIGS. 1 and 2;

FIG. 4 is a cross-sectional view taken along line 4—4 in FIG. 3;

FIG. 5 is a partial sectional view taken along the line 5—5 in FIG. 2;

DETAILED DESCRIPTION OF A PREFERRED EMBODIMENT OF THE INVENTION

Figure 1:
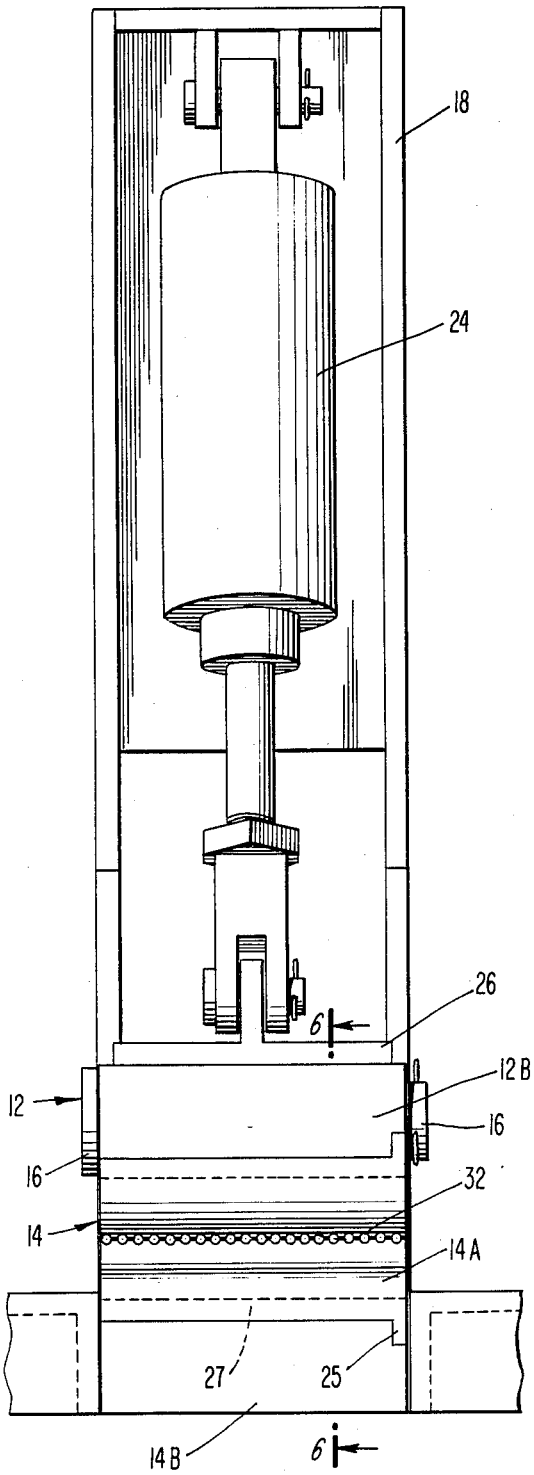
FIG. 1 is a front elevational view of a yarn entangling apparatus according to the present invention, wherein the blocks thereof are held together in an operative mode.
Figure 2:
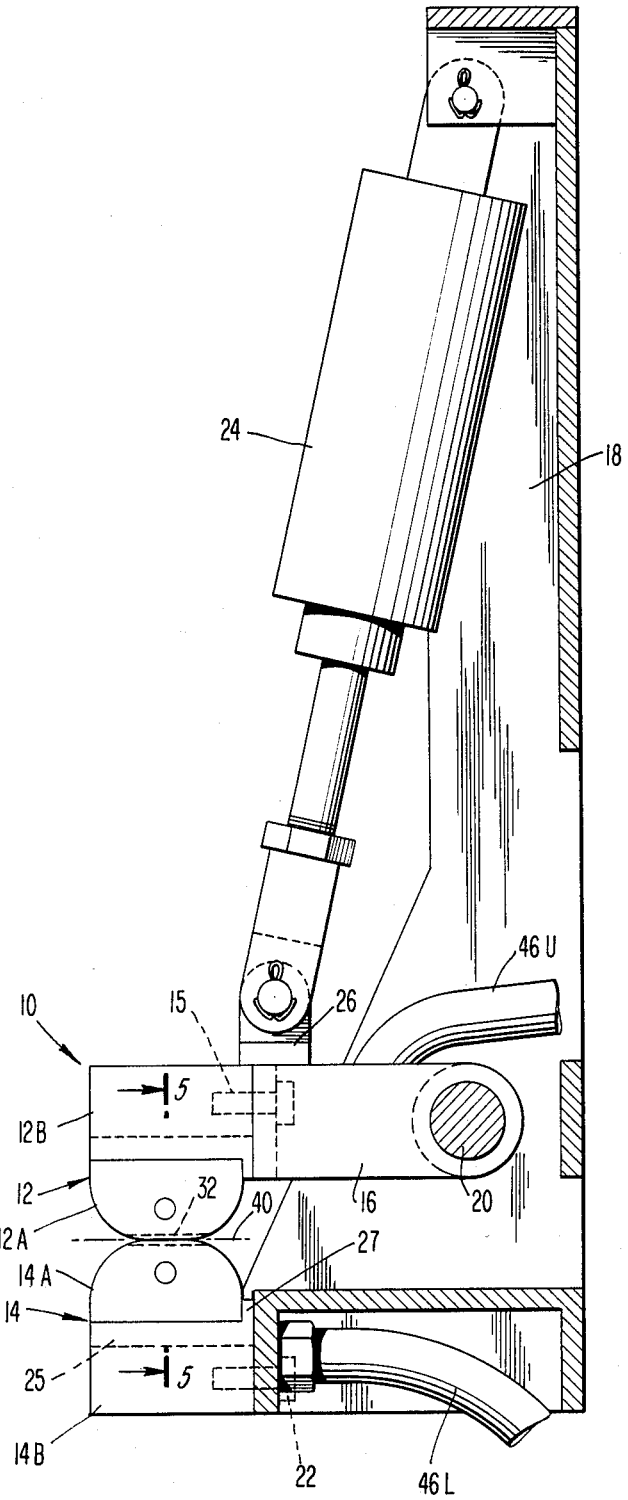
FIG. 2 is a side elevational view of the apparatus depicted in FIG. 1.

A filament entangling apparatus 10 according to the present invention comprises a pair of blocks 12, 14 which are arranged so as to be mated in mutually superimposed relationship, e.g. one upon the other. The upper block 12 is affixed by screws 15 to the ends of a pair of pivot arms 16 which are pivotably connected to a frame 18 by means of pivot pins 20.

The lower block 14 is affixed by screws 22 to a lower end of the frame 18. The upper block 12 can be raised from, and lowered onto, the lower block 14 by actuation of a motor, preferably a fluid cylinder 24 which is pivotably connected between the frame 18 and a bar 26 which interconnects the pivot arms 16. Any type of motor including an electrical motor will suffice, however. In lieu of a pivotal mounting for the upper block, the latter may be arranged to travel vertically upwardly in a linear path.

The blocks 12, 14 are identical, each carrying a plurality of parallel, semi-cylindrical channels 30U, 30L. When the blocks 12, 14 are mated, those semi-cylindrical channels cooperate to form parallel cylindrical yarn passages 32 through which the filamentary yarns travel. Any desired number of yarn passages can be formed.

Each block includes a head section 12A (or 14A) attached to a base section 12B (or 14B). The head sections 12A, 14A of the upper and lower blocks are mutually identical, and likewise the base sections 12B, 14B are mutually identical. Such identicalness is not mandatory, but it is useful in terms of simplified fabrication and a reduced chance of error during assemblage. Referring now to the lower block 14, the head section of that block 14 includes, along one end, a depending alignment flange 25 (FIG. 1) which fits into a correspondingly shaped alignment recess of the base section 14B. The base section 14B includes, along one side, a flange 27 (FIG. 4) which bears against one side of the head section 14A. Accordingly, it is possible to accurately insert the head section 14A onto the base section 14B in a predetermined orientation. Screws 29 (FIG. 3) are employed to secure the head section to the base section. The head section 14A carries the channel 30L.

Communicating with the channels 30U, 30L are fluid passages for conducting pressurized fluid, preferably water, into the yarn passages. Preferably, the fluid passages comprise radial fluid ports 34U in the upper head and ports 34L in the lower head which communicate with alternating ones of the channels, and a pair of tangential fluid ports 36U in the upper head and 36L in the lower head which communicate with the remaining alternating channels.

The radial ports 34U (or 34L) are disposed in the head section 12A (or 14A) of the respective block and are oriented generally radially with respect to the associated yarn passage 32. The tangential ports 36U (or 36L) are also located in the head section and are oriented generally tangentially with respect to the associated yarn passage 32. Thus, each yarn passage 32 receives fluid from two tangential ports 36U (or 36L) located on one side of the parting plane 40 between the blocks, and from one radial port 34U (or 34L) located on the other side of the parting plane. The fluid flows from the tangential ports 36U (or 36L) are disposed on opposite sides of the longitudinal axis of the respective yarn passage 32, whereby those flows will oppose one another within the yarn passage.

Communicating with the fluid ports 34U, 36U (or 34L, 36L) in each of the blocks is a fluid manifold conduit 42U (or 42L). That manifold conduit is disposed in the head section and communicates with a pair of infeed conduits 43 disposed in the base section. The infeed conduits each communicate with a source of fluid, such as water under pressure by means of a fluid line 46U (or 46L) which screws into a fitting 48U (or 48L) in the base section of the respective block.

The manifold conduit 42U (or 42L) includes end portions 49 of smaller cross-section than a central portion of the manifold conduit. The end portions may be drilled into the head section and then blocked-off by plugs 45 (FIG. 5). The infeed conduits 43 are drilled into the base section and then blocked-off by plugs 50 (FIG. 4). An oblong O-ring 47 (FIG. 4) is mounted in a groove formed in the base section so as to create a fluid-tight seal around the manifold conduit 42U (or 42L) and the infeed conduits 43 when the head and base sections are mutually assembled.

The end portions 49 of the manifold conduit 42U (or 42L) are of smaller diameter than the remaining central portion 51 of the conduit to enable the O-rings 47 to be arranged in surrounding relationship to the conduits 42U, 42L.

As an example, an entangling apparatus can be constructed in which there are sixteen yarn passages 32 which are each about 0.141 inches in diameter and are spaced apart from center-to-center by 0.394 inches. The water ports are each about 0.047 inches in diameter and conduct water at about 65 psi. The tangential ports are spaced apart (center-to-center) by about 0.093 inches and are spaced from an adjacent radial port on the same block by about 0.348 inches.

Figure 8:
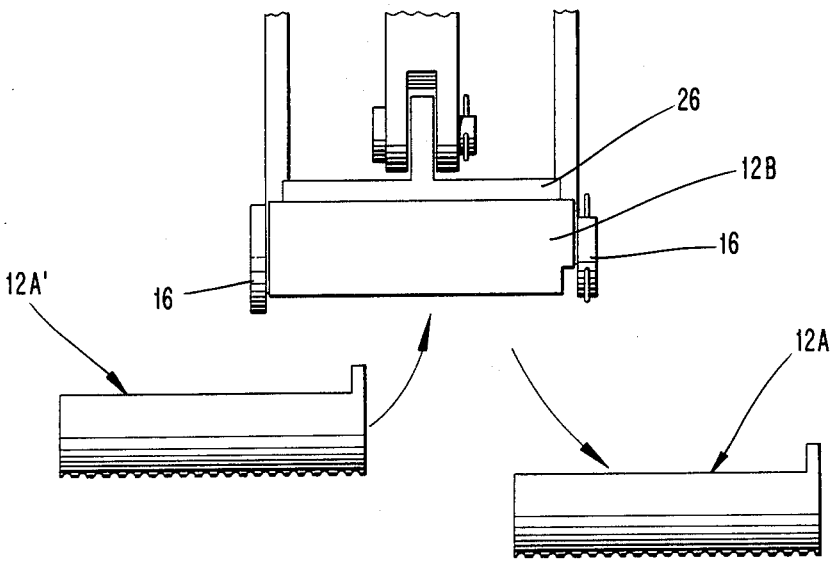
FIG. 8 is a schematic front elevational view of a block, depicting the interchangeability of head sections.

As noted earlier, the blocks 12 and 14 are of identical construction. The relationship between the fluid ports for each yarn passage is achieved by taking two identical blocks and turning one 180 degrees until the tangential ports of each block are associated with the radial ports of the other block, as can be viewed in FIG. 5. In this fashion, the overall fabrication costs are somewhat reduced since blocks of only one configuration need be formed. If it is desired to adapt the blocks to an operation involving a different number of yarns, it is merely necessary to remove and replace the head section 12A (or 14A) of each block with a new head section 12A' having the appropriate number of yarn passages as depicted in FIG. 8.

Figure 7:
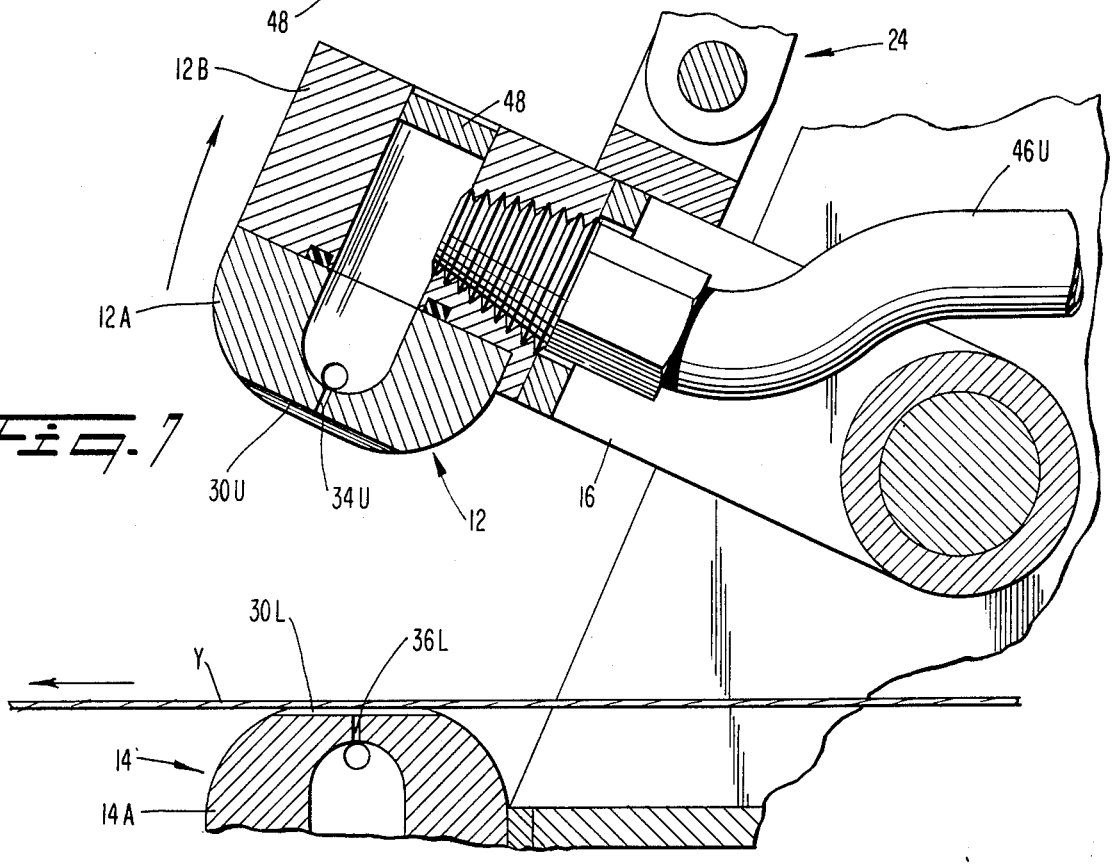
FIG. 7 is a view similar to FIG. 6 after an upper one of the blocks has been raised to open the yarn passages.

In operation, yarns are strung up after the block 12 has been raised by the cylinder 24 and thus separated from the lower block 14 (see FIG. 7). The yarns Y are then laid into respective ones of the channels 30L of the lower block. Alignment of the yarns and respective channels can be facilitated by employing grooved rolls (not shown) located upstream and downstream of the lower block 14. That is, each grooved roll would contain a plurality of circumferential grooves corresponding to the number of channels. The upstream and downstream grooves would be aligned with respective ones of the channels. When posititioned in its grooves, each yarn would be automatically positioned within its respective channel.

Figure 6:
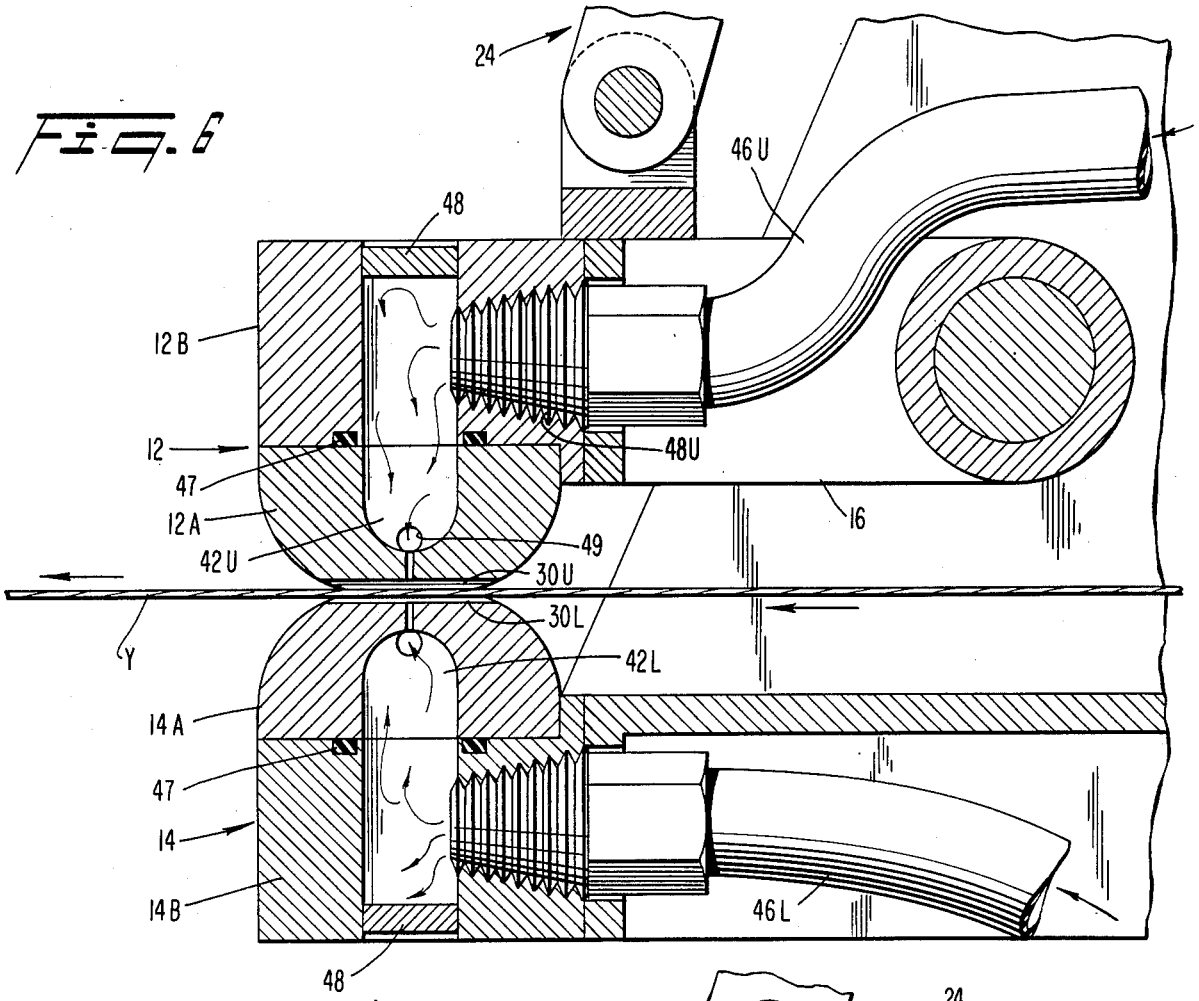
FIG. 6 is a sectional view taken along the lines 6—6 in FIG. 1.

The upper block 12 is then lowered onto the lower block 14 to fully define the yarn passages 32 and enclose the yarn therein (see FIG. 6). Pressurized water is fed through the water ports 34U, 36U, 34L, 36L as the yarns are fed through the yarn passages. The resultant turbulence encountered by the yarns within the yarn passages produces the desired degree of entanglement of the filaments.

At regular intervals, e.g., each half hour, the water is shut off and the upper block 12 is raised while the yarn continues to be fed. As a result, any trash which may have accumulated at the upstream end of the yarn passages is pulled through the passages by the traveling yarn. As noted earlier, such trash travels upon the yarns, but is unable to pass through the yarn passages, due to the pressurized water being expelled therefrom. If not removed, that trash can build-up and obstruct the inlet of the yarn passage to such an extent that the filaments are caused to be broken. However, that problem is avoided in accordance with the present invention since the blocks are easily separated, allowing the trash to be pulled through the yarn passages. This step can be performed rapidly. Furthermore, there are no string-up slots as used in the prior art jets which slots often become clogged.

It has been found that yarns entangled by the present invention exhibit a significantly smaller fuzz level. It is surmized that this may be attributable at least to some extent to the absence of a string-up slot. That is, as discussed earlier herein, in previously utilized jets, slots are provided which communicate with the yarn passages in order to enable the yarns to be inserted into the yarn passages. However, at the place where each slot intersects the respective yarn passage, corners are formed. It is likely that as the yarn is impelled against those corners while being whipped around by the water turbulence, some of the filaments are broken, thereby increasing the fuzz level. By avoiding the use of such corners, the present jet presents a smooth surface completely surrounding the yarn, whereby only minimal damage to the filaments occurs. Thus, yarn processed in accordance with the present invention exhibits improved fuzz levels.

The water ports can be cleaned relatively easily and quickly at their inlets and outlets by removing the replaceable heads. Furthermore, if it becomes necessary to change the size or number of the yarn passages to accomodate different sizes or numbers of yarns, it is merely necessary to substitute different heads. This avoids the need to disconnect the water hoses 46U, 46L.

Since the channels 30U, 30L are formed in common blocks, it is possible to locate those channels very close together, whereby a maximum number of yarn passages can be employed per unit of length of the block. This means that the block structure required for accommodating a given number of yarns can be smaller than heretofore possible.

Since the blocks 12, 14 are identical, the initial fabrication costs and start-up capital are reduced appreciably.

Although the invention has been described in connection with a preferred embodiment thereof, it will be appreciated by those skilled in the art that additions, modifications, substitutions, and deletions may be made without departing from the spirit and scope of the invention as defined by the appended claims.

We claim:

1. In an apparatus for entangling a plurality of bundles of filamentary material of the type comprising first and second blocks positionable against one another, each said block comprising a plurality of channels arranged so that when said blocks are positioned against one another, the channels of one block mate with the channels of the other block to form passages through which respective bundles of filamentary material may pass, each block including fluid ports communicating with respective ones of said passages to conduct pressurized fluid thereto in order to create turbulence within respective ones of said passages for entangling said bundles, the improvement wherein said blocks are rapidly separable and are adapted to be converted to blocks having a different bundle capacity, said improvement comprising the formation of each of said blocks of a base section and a head section removably mounted to said base section, said head section containing said channels, there being provided a plurality of said sections which are configured to be interchangeably mountable on said base section and which are of different bundle capacity, releasable fastening means for securing any one of said head sections to said base section to enable said head sections to be interchanged, and mechanical means for mutually separating said blocks to provide simultaneous and immediate access to the interior of said yarn passages.

2. Apparatus according to claim 1, wherein said base section carries fluid conduit means comprising a manifold conduit extending transversely relative to the direction of yarn travel and communicating with all of the fluid ports associated with that block, seal means disposed between said head and base sections to seal around said conduit means.

3. Apparatus according to claim 1, wherein each said yarn passage presents a continuous surface surrounding the associated yarn except for said fluid ports.

4. Apparatus according to claim 1 wherein said blocks each include a manifold conduit extending transversely relative to the direction of yarn travel and communicating with all of the fluid ports associated with that block, said manifold being of smaller cross-section for a portion of its length at each of its ends.

5. Apparatus according to claim 1, including a source of pressurized liquid connected to said fluid ports.

6. Apparatus according to claim 1, wherein there are a plurality of said fluid ports communicating with each of said passages, there being a radially extending fluid port in one of said blocks and a pair of tangentially extending fluid ports in the other of said blocks.

7. Apparatus according to claim 1, wherein said blocks are vertically superimposed relative to one another, one of said blocks being stationary mounted and the other being movable by said mechanical means.

8. Apparatus according to claim 1, wherein said head and base sections include mutually engageable abutment means for orienting said head section relative to said base section.

9. Apparatus to claim 1, wherein said fluid ports are disposed in said head section and said base section includes fluid conduit means communicating with said ports.

10. Apparatus according to claim 1, wherein said mechanical means comprises motor actuated means.

11. Apparatus according to claim 10, wherein said motor actuated means comprises a fluid driven ram.

12. Apparatus according to claim 10, wherein said motor actuated means defines the sole means for maintaining said blocks together.

13. An apparatus for entangling filamentary yarn comprising:

(a) first and second blocks positionable in mutually superimposed relationship, each block including (1) a head section carrying (i) a plurality of channels located so that when said blocks are in superimposed relationship, respective ones of said channels are aligned to define yarn passages through which yarn can be fed, and (ii) a plurality of fluid ports communicating with said yarn passages and being communicable with pressurized fluid to create a turbulent fluid flow within respective ones of said yarn passages for entangling the yarns, and (2) a base section on which said head section is removably attached, said base section including fluid conduit means communicable with said fluid ports when said head section is attached to said base section, said fluid conduit means comprising a manifold conduit extending transversely relative to the direction of yarn travel and communicating with all of the fluid ports associated with that block, said manifold conduit being of smaller cross-section at its ends than in its center; and (b) means for separating said first and second blocks to provide simultaneous and instant access to the interior of said yarn passages.

14. Apparatus according to claim 13, wherein each said block includes seal means between said head and base sections to seal around said conduit means.

15. Apparatus according to claim 13, wherein said blocks are disposed one above the other.

16. Apparatus according to claim 13, wherein there are a plurality of said ports associated with each said passage.

17. An apparatus for entangling filamentary yarn comprising:

(a) first and second blocks positionable in mutually superimposed relationship, each said block including (1) a head section carrying (i) a plurality of channels located so that when said blocks are in superimposed relationship, respective ones of said channels are aligned to define yarn passages through which yarn can be fed, and (ii) a plurality of fluid ports communicating with said yarn passages and being communicable with pressurized fluid to create a turbulent fluid flow within respective ones of said yarn passages for entangling the yarns, and (2) a base section on which said head section is removably attached, said base section including fluid conduit means communicable with said fluid ports when said head section is attached to said base section, said head and base sections including mutually engageable alignment means which are engageable only when said head section is installed in a predetermined orientation on said base section; and (b) means for separating said first and second blocks to provide simultaneous and instant access to the interior of said yarn passages.

18. Apparatus according to claim 17, wherein said blocks are disposed one above the other.

19. Apparatus according to claim 17, there are a plurality of said ports associated with each said passage.

20. An apparatus for entangling filamentary yarn comprising:

(a) first and second blocks positionable in mutually superimposed relationship, each said block including (1) a head section carrying (i) a plurality of channels located so that when said blocks are in superimposed relationship, respective ones of said channels are aligned to define yarn passages through which yarn can be fed, and (ii) a plurality of fluid ports communicating with said yarn passages and being communicable with pressurized fluid to create a turbulent fluid flow within respective one of said yarn passages for entangling the yarns, (2) a base section on which said head section is removably attached, said base section including fluid conduit means communicable with said fluid ports when said head section is attached to said base section, and (3) seal means between said head and base sections to seal around said conduit means, and (b) means for separating said first and second blocks to provide simultaneous and instant access to the interior of said yarn passages.

21. Apparatus according to claim 20, wherein said blocks are disposed one above the other.

22. Apparatus according to claim 20, wherein there are a plurality of said ports associated with each said passage.

* * * * *